US010502445B2

(12) United States Patent
Matambo et al.

(10) Patent No.: US 10,502,445 B2
(45) Date of Patent: Dec. 10, 2019

(54) WALL-MOUNT AIR CONDITIONER AND METHOD INVOLVING SAME

(71) Applicant: Airxcel, Inc., Wichita, KS (US)

(72) Inventors: Thompson Joshua Matambo, Warner Robins, GA (US); Paul Franklin Fay, Cordele, GA (US); William James Wilson, Cordele, GA (US); Vikas Dhummi Chandrashekar, Warner Robins, GA (US)

(73) Assignee: Airxcel, Inc., Wichita, KS (US)

( * ) Notice: Subject to any disclaimer, the term of this patent is extended or adjusted under 35 U.S.C. 154(b) by 250 days.

(21) Appl. No.: 15/601,839

(22) Filed: May 22, 2017

(65) Prior Publication Data

US 2018/0335220 A1 Nov. 22, 2018

(51) Int. Cl.

| | |
|---|---|
| ***F24F 11/74*** | (2018.01) |
| ***F24F 1/0022*** | (2019.01) |
| ***F24F 1/0033*** | (2019.01) |
| ***F24F 7/013*** | (2006.01) |
| ***F24F 13/12*** | (2006.01) |
| ***F24F 13/20*** | (2006.01) |
| ***F24F 1/0057*** | (2019.01) |
| ***F24F 1/0007*** | (2019.01) |
| ***F24F 11/00*** | (2018.01) |
| ***F24F 1/0035*** | (2019.01) |

(52) U.S. Cl.

CPC ..... *F24F 11/74* (2018.01); *F24F 1/0007* (2013.01); *F24F 1/0022* (2013.01); *F24F 1/0033* (2013.01); *F24F 1/0035* (2019.02); *F24F 1/0057* (2019.02); *F24F 7/013* (2013.01); *F24F 11/0001* (2013.01); *F24F 13/12* (2013.01); *F24F 13/20* (2013.01); *F24F 2011/0002* (2013.01); *F24F 2011/0006* (2013.01)

(58) Field of Classification Search

CPC .. F24F 11/74; F24F 1/0035; F24F 1/02; F24F 1/028; F24F 1/029

See application file for complete search history.

(56) References Cited

U.S. PATENT DOCUMENTS

| | | | | |
|---|---|---|---|---|
| 3,139,020 A * | 6/1964 | Schemenauer | F24F 1/0007 | 454/267 |
| 3,958,628 A * | 5/1976 | Padden | F24F 3/14 | 165/222 |
| 4,072,187 A * | 2/1978 | Lodge | F24F 13/20 | 165/137 |
| 4,987,952 A * | 1/1991 | Beal | F24F 1/022 | 165/225 |

(Continued)

*Primary Examiner* — Cassey D Bauer

(74) *Attorney, Agent, or Firm* — Hovey Williams LLP

(57) ABSTRACT

A single-package, wall-mount air conditioner is provided with an economizer unit having a pair of vertical conduits for delivering fresh outside air to a pair of blowers and a damper system that can be selectively positioned to open and close the conduits. The damper system also opens and closes return air recirculation openings through which return air is delivered to the blowers. When the air conditioner is operating in an economizer cooling mode, the return air recirculation openings are partially or completely closed and some or all of the return air is discharged outwardly and upwardly from the air conditioner in a manner to impede any entrainment of the discharged return air with the fresh outside air that is entering the air conditioner.

14 Claims, 10 Drawing Sheets

(56) References Cited

U.S. PATENT DOCUMENTS

| | | | | |
|---|---|---|---|---|
| 5,485,878 | A * | 1/1996 | Derks | F24F 3/044 165/137 |
| 6,295,823 | B1 * | 10/2001 | Odom | F24F 1/0007 62/176.6 |
| 2009/0133851 | A1 * | 5/2009 | Caldwell | F24F 12/006 165/54 |
| 2013/0017774 | A1 * | 1/2013 | Zorzit | F24F 1/0007 454/239 |
| 2018/0335220 | A1 * | 11/2018 | Matambo | F24F 11/74 |

* cited by examiner

WALL-MOUNT AIR CONDITIONER AND METHOD INVOLVING SAME

BACKGROUND OF THE INVENTION

The present invention relates generally to heating, ventilating and air conditioning systems and, more particularly, to single-package, wall-mount air conditioners for use in cooling buildings or rooms within buildings in need of cooling and/or ventilation.

Single-package, wall-mount air conditioners are mounted to an exterior side of an exterior wall of a building or a room within a building and incorporate both evaporator and condenser coil assemblies within a single cabinet. These wall-mount air conditioners are typically used to deliver conditioned or ventilation air to enclosed structures such as classrooms, telecommunication shelters, electronic equipment rooms, and any other buildings or rooms within buildings in need of cooling and/or ventilation.

In a typical construction, these wall-mount air conditioners include an internal evaporator compartment that is positioned at an upper portion of the cabinet and houses the evaporator coil assembly, a blower box that is positioned below the evaporator coil assembly and houses one or more blowers, and a condenser compartment positioned that is positioned below the blower box and houses the condenser coil assembly. Conditioned supply air is delivered from the evaporator compartment through a supply air opening in the exterior wall of the building and into the building. Return air is delivered from within the building to the blower box through a return air opening in the exterior wall 12 and is then recirculated by the blowers to the building through the evaporator compartment as conditioned supply air. A large fan in the condenser compartment draws in outside air and blows it across the condenser coil assembly to cause cooling of the heat exchange medium within the condenser coils.

Some types of these wall-mount air conditioners include an economizer unit that allows the air conditioner to be operated without mechanical cooling by drawing in fresh outside air when that air is sufficiently cool to handle the heating load within the building. When the air conditioner is operating in this economizer cooling mode, a damper assembly is placed in a position to allow fresh outside air to be drawn by the blowers into the blower box and then delivered into the building through the evaporator compartment. Some or all of the return air from the building is then redirected to the condenser compartment and exhausted outwardly from the cabinet during the economizer cooling mode of operation.

The economizer unit is positioned generally in-line with the return air opening in the exterior wall between the blower box and the condenser compartment. The fresh outside air intake for the economizer unit may thus be positioned in close proximity to the exhaust for the condenser compartment. As a result, some of the return air that is exhausted from the condenser compartment may enter the economizer unit through the fresh outside air intake. The mixing of the warmer return air with the fresh outside air is disadvantageous because it may increase the temperature of the air mixture enough to exceed the set point temperature that causes the air conditioner to switch from the economizer cooling mode to the mechanical cooling mode. A need has thus arisen for improvements to these wall-mount air conditioners that will reduce the mixing of return air with fresh outside air so that they may operate in the economizer cooling mode for extended periods of time and thereby benefit from the reduced operational costs that result from operating in the economizer cooling mode.

SUMMARY OF THE INVENTION

In one aspect, the present invention is directed to a single-package, wall-mount air conditioner operable in a mechanical cooling mode and an economizer cooling mode. The single-package, wall-mount air conditioner comprises: a cabinet comprising a pair of side panels, a front panel, a rear panel, a top panel, and a bottom panel that are interconnected together; a supply air opening in the rear panel through which cooling supply air may be discharged from the cabinet; a return air opening in the rear panel through which the cooling supply air after discharge from the cabinet may be recirculated to the cabinet as return air; a compression refrigeration system positioned within the cabinet and operable to cause cooling of the supply air within the cabinet when the air conditioner is operating in the mechanical cooling mode; an opening in the cabinet through which fresh outside air may enter the cabinet; a return air discharge opening in the cabinet through which the return air in the cabinet may be outwardly discharged; a return air recirculation opening within the cabinet through which the return air in the cabinet may be routed to the supply air opening; a duct in communication with the return air discharge opening and having an imperforate portion positioned to upwardly turn the outwardly discharged return air; a blower within the cabinet for effecting movement of the supply air, the return air, and the fresh outside air within the cabinet; and an economizer unit positioned within the cabinet and comprising a conduit through which the fresh outside air may flow and a damper system that is selectively operable to open and close said conduit to said flow of the fresh outside air through the conduit and to open and close said return air recirculation opening to said routing of the return air to the supply air opening.

In another aspect, said single-package, wall-mount air conditioner comprises: a cabinet comprising a pair of side panels, a front panel, a rear panel, a top panel, a bottom panel, that are interconnected together, said cabinet including divider walls that extend between the side, front and rear panels to separate an evaporator compartment from a blower compartment, the blower compartment from an economizer compartment, and the economizer compartment from a condenser compartment within the cabinet; a supply air opening in the rear panel through which cooling supply air may be discharged from the evaporator compartment; a return air opening in the rear panel through which the cooling supply air after discharge from the cabinet may be recirculated to the economizer compartment as return air; a compression refrigeration system positioned within the cabinet and operable to cause cooling of the supply air within the cabinet when the air conditioner is operating in the mechanical cooling mode, said compression refrigeration system comprising an evaporator coil assembly positioned in the evaporator compartment and a condenser coil assembly and an exhaust fan unit positioned in the condenser compartment; an opening in the cabinet through which fresh outside air may enter the condenser compartment; a return air discharge opening in the cabinet through which the return air in the economizer compartment may be outwardly discharged from the cabinet; a return air recirculation opening in the divider wall separating the blower compartment from the economizer compartment through which the return air in the economizer compartment may be routed to the blower compartment; a duct extending from the return air discharge opening and having an imperforate portion positioned to upwardly turn the outwardly discharged return air; a blower positioned in the blower compartment for effecting movement of the supply air, the return air, and the fresh outside air within the cabinet; and an economizer unit positioned within the economizer compartment and comprising a conduit through which the fresh outside air may flow from the condenser compartment to the blower compartment and a damper system that is selectively operable to open and close said conduit to said flow of the fresh outside air through the conduit and to open and close said return air recirculation opening to said routing of the return air from the economizer compartment to the supply air opening.

In another aspect, the present invention is directed to a method of operating an economizer unit in a single-package, wall-mount air conditioner. While the single-package, wall-mount air conditioner is operating in an economizer cooling mode, the method comprises the steps of: drawing fresh outside air upwardly through a conduit in the economizer unit and delivering it to a blower compartment for subsequent delivery as cooling supply air to a building; and fully or partially blocking delivery of return air through the economizer unit to the blower compartment and redirecting it outwardly from the economizer unit. While the single-package, wall-mount air conditioner is operating in a mechanical cooling mode, the method comprises the steps of: blocking said fresh outside air from being drawn upwardly through the conduit in the economizer unit; and allowing the return air to flow through the economizer unit to the blower compartment for subsequent cooling and then delivery to the building.

BRIEF DESCRIPTION OF THE DRAWINGS

In the accompany drawings that form part of the specification and in which like reference numerals are used to indicate like components in the various views.

DETAILED DESCRIPTION

Figure 1:
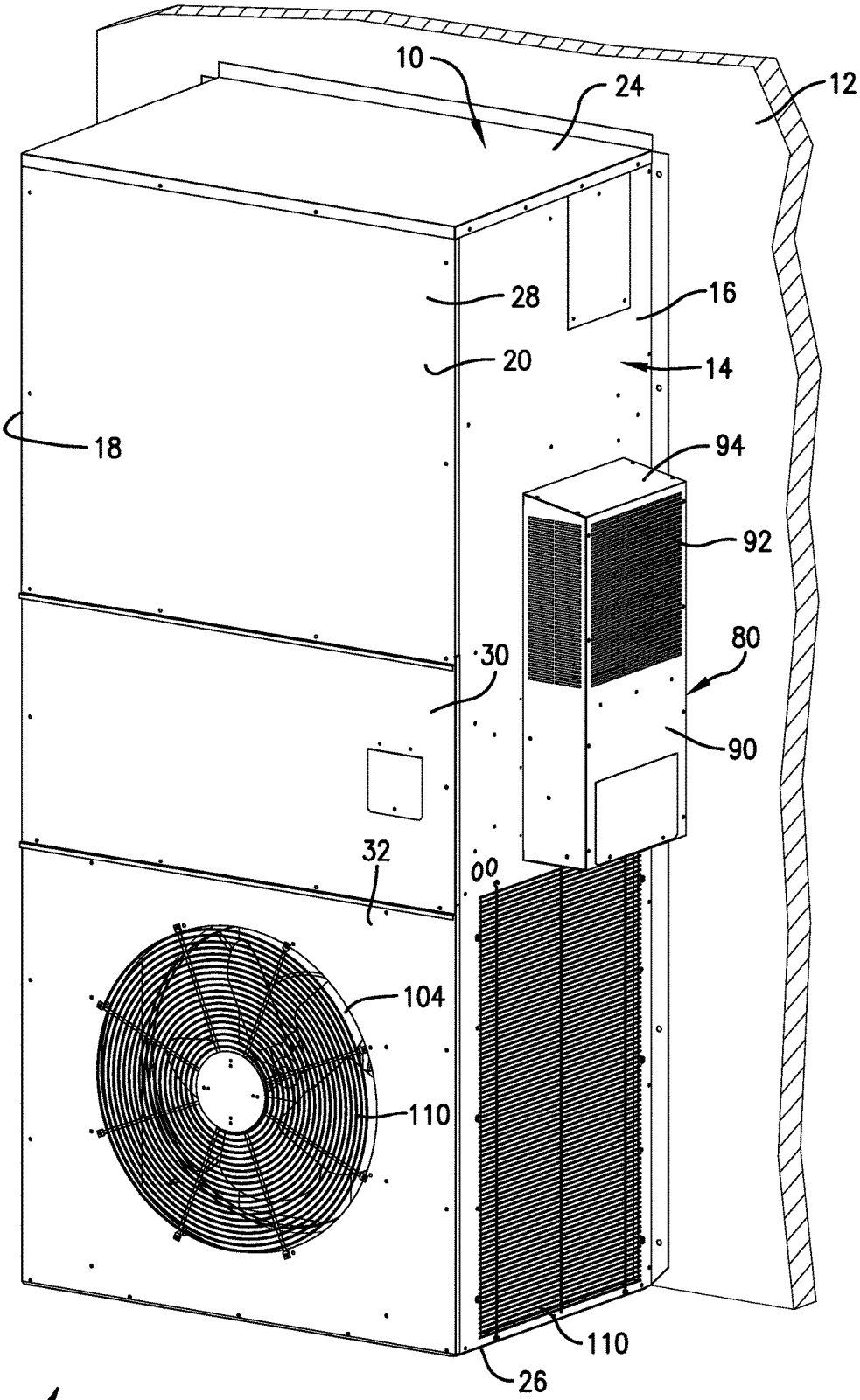
FIG. 1 is a front perspective view of a single-package, wall-mount air conditioner constructed in accordance with one embodiment of the present invention and shown mounted to a fragmental portion of a wall.
Figure 2:
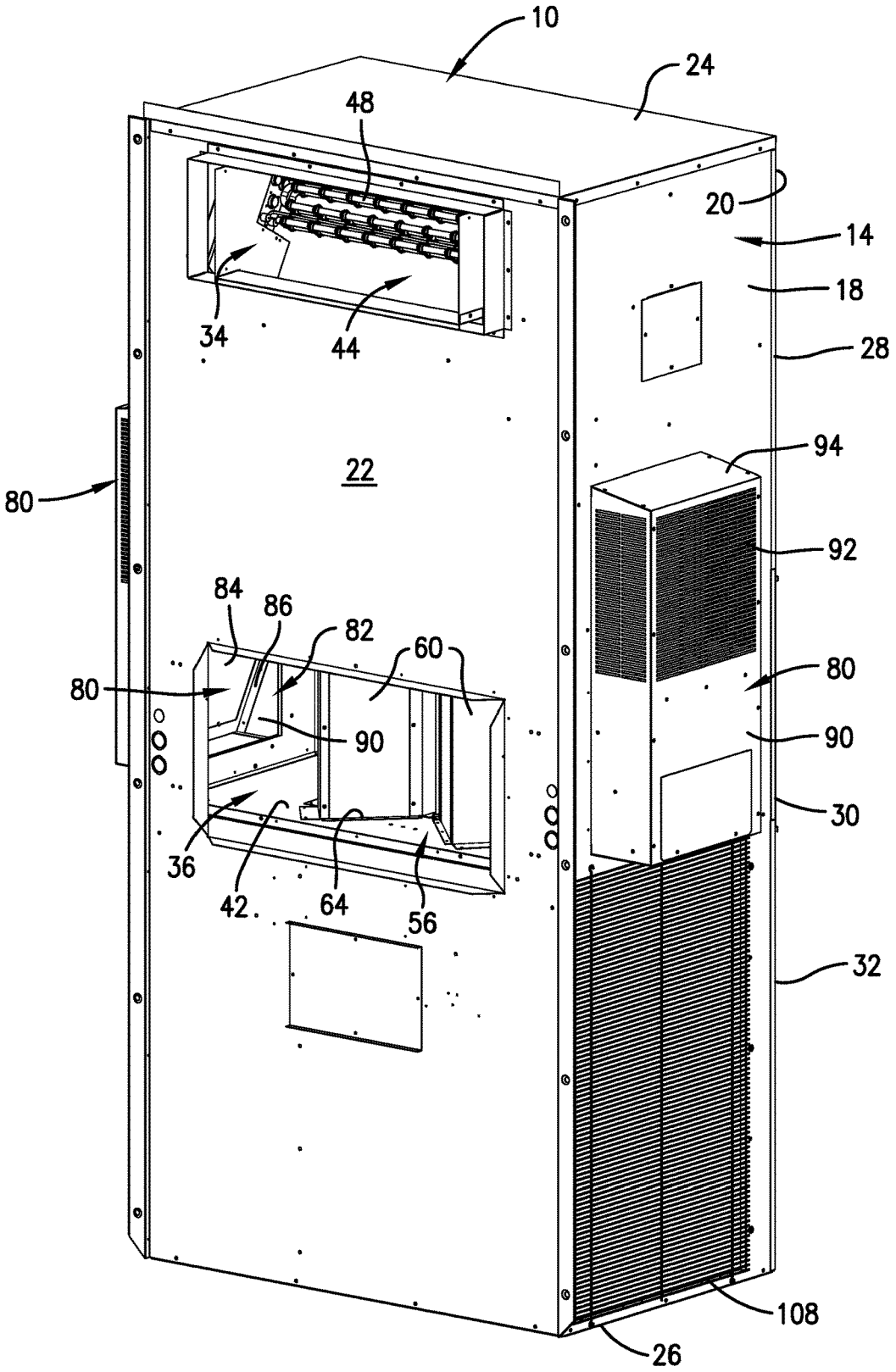
FIG. 2 is a rear perspective view of the air conditioner of FIG. 1.
Figure 3:
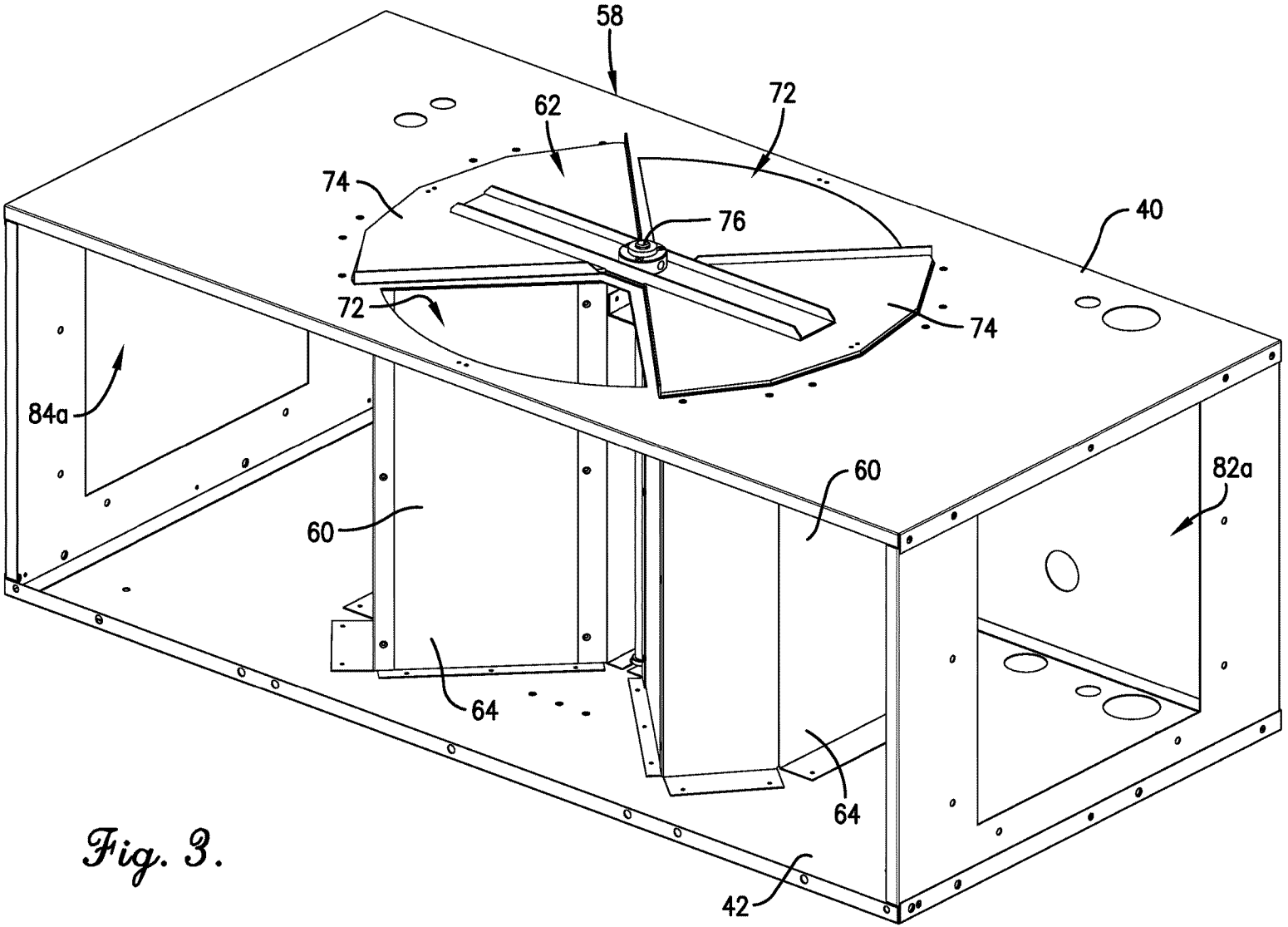
FIG. 3 is a front perspective view of an economizer unit that is used within the air conditioner of FIGS. 1 and 2 and shown on an enlarged scale from that used in FIGS. 1 and 2 and showing a damper system as positioned when the air conditioner is operating in a mechanical refrigeration mode.

Turning now to the drawings in greater detail and initially to FIGS. 1 and 2, a single-package, wall-mount air conditioner is designated generally by the numeral 10 and is shown mounted to an exterior wall 12 of an enclosed structure. The enclosed structure may be a classroom, telecommunication shelter, electronic equipment room, shed or cabinet, and any other building or room within a building that is in need of cooling and/or ventilation supplied by the air conditioner 10. The air conditioner 10 operates generally to deliver supply air through a supply air opening (not shown) in the exterior wall 12 into the enclosed structure and return air is delivered from within the enclosed structure to the air conditioner 10 through a return air opening (not shown) in the exterior wall 12.

The air conditioner 10 has an exterior box-like cabinet 14 that is formed from spaced-apart side panels 16 and 18, front and rear panels 20 and 22, and top and bottom panels 24 and 26. Each of the panels 16, 18, 20, 22, 24 and 26 is typically fashioned from sheet metal and may be attached to adjoining panels by screws that extend through the panels and into flanges that are formed along the edges of at least some of the panels.

The front panel 20 in one embodiment includes an upper access panel 28, a middle access panel 30 and a lower access panel 32. The rear panel 22 includes a flanged supply air opening 34 positioned close to the top panel 24 for delivering supply air through an aligned opening (not shown) in the exterior wall 12 and then into the enclosed structure. The rear panel 22 includes a flanged return air opening 36 position roughly midway between the top panel 24 and the bottom panel 26 for delivering return air from the enclosed structure through an aligned opening (not shown) in the exterior wall 12 and then into the cabinet 14.

As can best be seen in FIGS. 7-10, in one embodiment the interior of the cabinet 14 is divided into four discrete compartments superimposed one above the other by a series of three vertically spaced-apart divider walls 38, 40, and 42 that extend horizontally between the side panels 16 and 18 and the front and rear panels 20 and 22. An evaporator compartment 44 is located at the top of the cabinet 14 and is bounded at the top by the top panel 24 and at the bottom by the divider wall 38. The evaporator compartment 44 houses an evaporator coil assembly 46 that is shown somewhat schematically and forms part of a compression refrigeration system, the details of which are well known to those of ordinary skill in this field and need not be set forth herein. An optional heating unit 48 may also be housed in the evaporator compartment 44.

A blower compartment 50 immediately underlies the evaporator compartment 44 and is bounded at the top by the divider wall 38 and at the bottom by the divider wall 40. The blower compartment 50 houses a pair of blowers 52 that circulate air through the cabinet 14 and deliver the supply air into the enclosed structure. When the air conditioner 10 is operating in the mechanical cooling mode, the blowers 52 draw return air from the enclosure structure and deliver it to the evaporator compartment 44. When the air conditioner 10 is operating in the economizer cooling mode, the blowers 52 draw fresh outside air into the cabinet 14 and deliver it to the evaporator compartment 44 through a pair of openings 54 in the divider wall 38 that are aligned with respective discharge outlets of the blower 52. When the fresh outside air is at a relatively low temperature as described in greater detail below, the blowers 52 may also draw some return air from the return air opening 36 for mixing with the fresh outside air that is delivered to the evaporator compartment 44. The resulting mixture may thus be warm enough to avoid the need for activation of the heating unit 48 while obtaining the ventilation benefits of circulating the fresh outside air as part of the supply air that is delivered into the enclosed structure.

An economizer compartment 56 is positioned immediately below the blower compartment 50 and is bounded at the top by the divider wall 40 and at the bottom by the divider wall 42. An economizer unit 58 is positioned within the economizer compartment 56 and comprises a pair of vertically-extending conduits 60 and a damper system 62 associated with the conduits 60. The conduits 60 each have a lower inlet end 64 in communication with a source of fresh outside air and an upper discharge end 66 in fluid flow communication with one of the blowers 52. As a result of operation of the blowers 52, a pressure differential is created within the conduits 60 and fresh outside air is able to flow upwardly through the conduits 60 for delivery by the blowers 52 to the evaporator compartment 44 and then to the enclosed structure.

Turning additionally to FIGS. 3-6, in one embodiment, the lower inlet end 64 of each conduit 60 is aligned with an opening 68 in the divider wall 42 and the upper discharge end of each conduit 60 is aligned with an opening 70 in the divider wall 40. It will be appreciated that the economizer unit 58 may have upper and/or lower walls that are separate from the divider walls 40 and 42, in which case the openings 68 are positioned in both the upper wall and divider wall 40 and the openings 70 are positioned in both the lower wall and the divider wall 42. The damper system 62 is operable to restrict and to totally close the conduits 60 against the flow of the fresh outside air through the conduits 60 when the air conditioner 10 is operating in the mechanical cooling mode. A pair of return air recirculation openings 72 may be provided in the divider wall 40 to allow return air to be recirculated into the blower compartment 50 and then delivered by the blowers 52 into the evaporator compartment 44 when the air conditioner is operating in the mechanical cooling mode. The damper system 62 is also operable to restrict and to totally close the return air recirculation openings 72 when the air conditioner 10 is operating in the economizer cooling mode.

In one embodiment, the damper system 62 includes one or more plates 74 that may be positioned to block passage of fresh outside air through the conduits 60 and to block passage of return air through the return air recirculation openings 72. Each one of the plates 74 may be movable to restrict or totally block the flow of fresh outside air through one of the conduits 60 and the same plate may be movable to also restrict or totally block the flow of return air through one of the return air recirculation openings 72.

In one particular exemplification, the upper discharge ends 66 of the conduits 60 are coplanar with the return air recirculation openings 72 and are shaped and arranged so that they form opposing sectors of a common circle. The return air recirculation openings 72 are likewise shaped and arranged so that they form opposing sections of the same common circle containing the upper discharge ends 66 of the conduits 60. The sector formed by one of the upper discharge ends 66 of the conduits 60 is normally of the same, but may be of a different, angular dimension as the other one of the upper discharge ends 66 of the conduits 60. Likewise, the sector formed by one of the return air recirculation openings 72 may be of a different, angular dimension as the other one of the return air recirculation openings 72. The angular dimensions of the sectors of the upper discharge ends 66 of the conduits 60 may be the same as or different from the angular dimensions of sectors of the return air recirculation openings 72. In one embodiment, the sectors are the same angular dimension and are within a few degrees of being quadrants.

Figure 4:
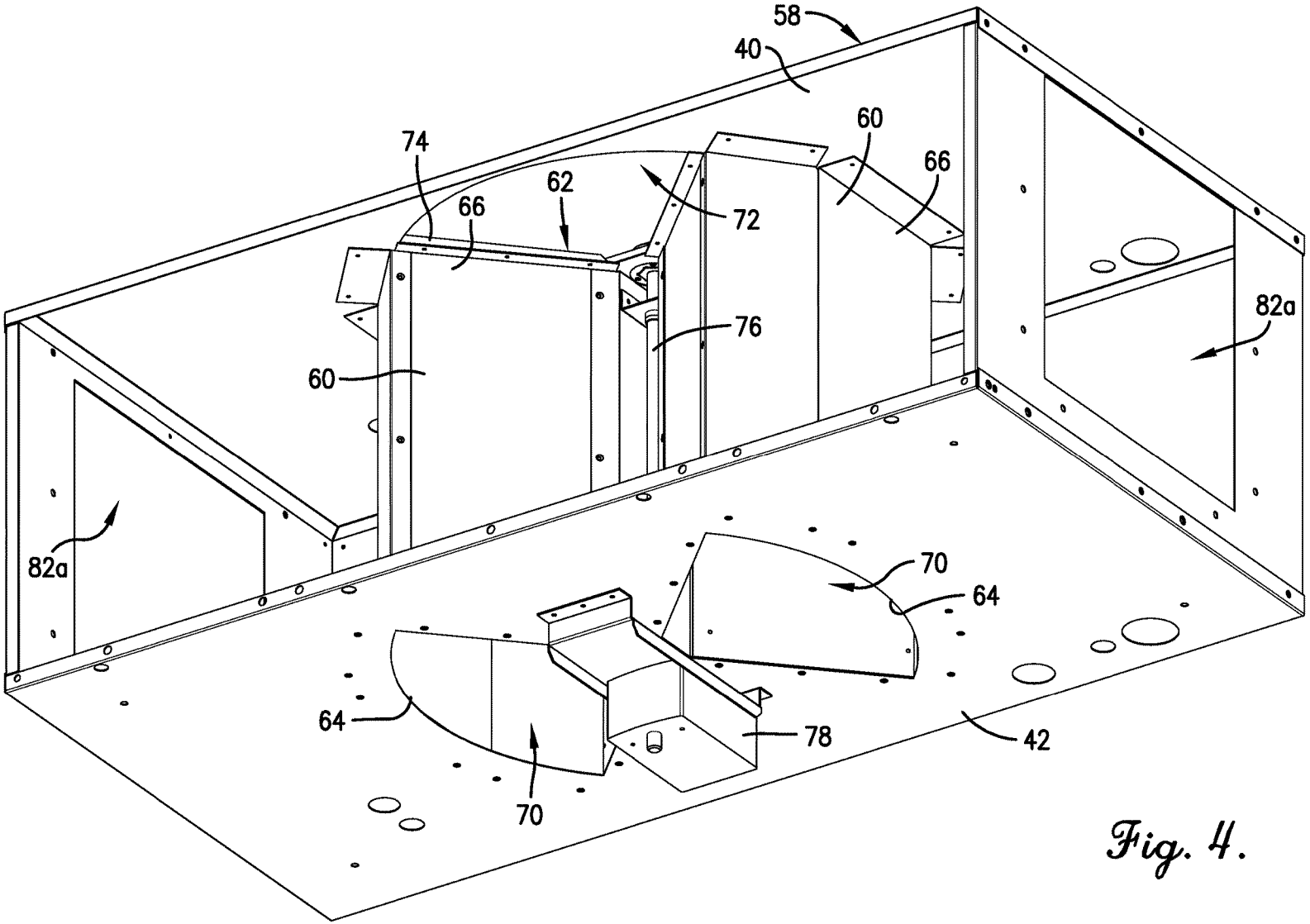
FIG. 4 is a bottom perspective view of the economizer unit shown in FIG. 3.
Figure 5:
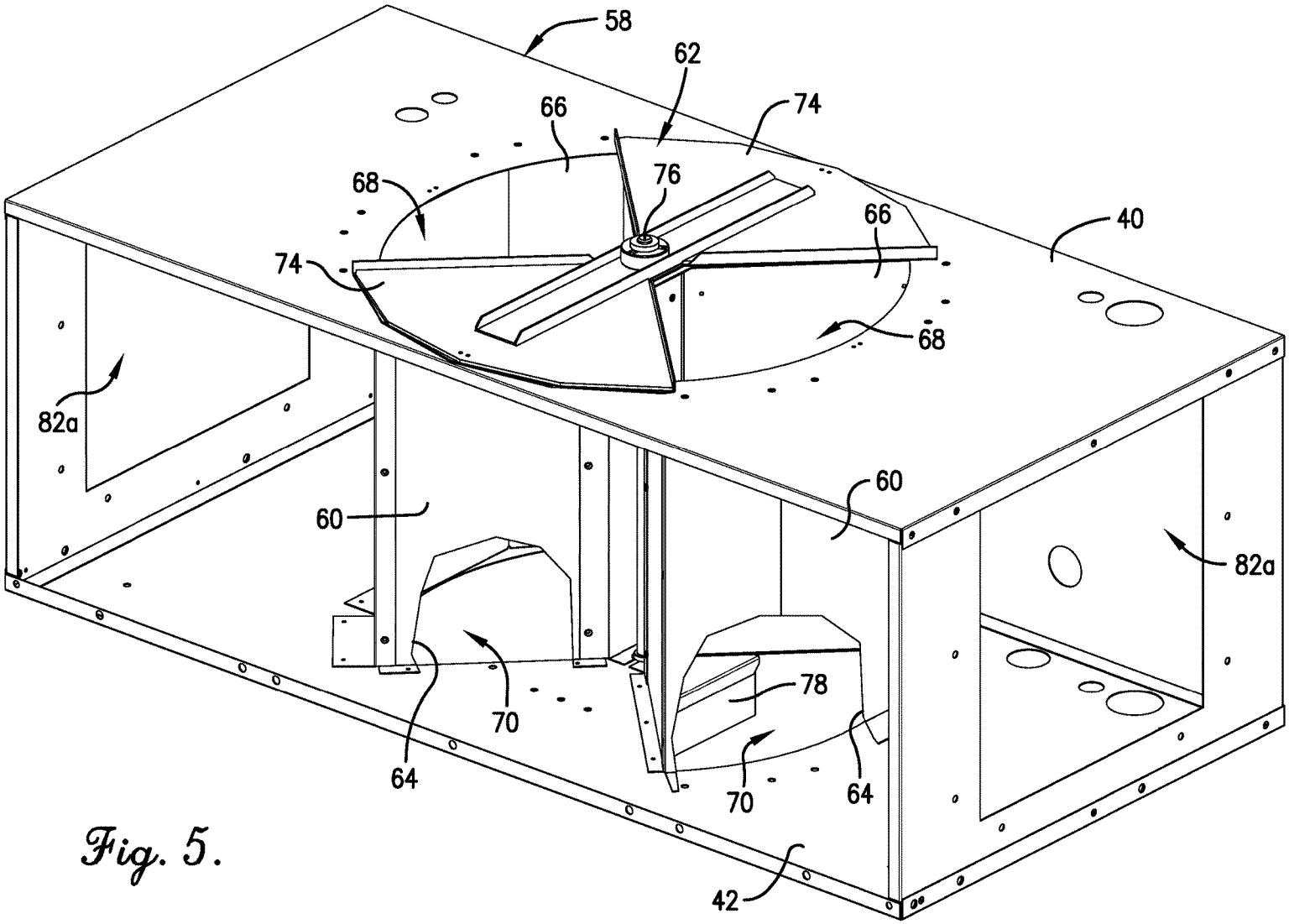
FIG. 5 is a rear perspective view of the economizer unit similar to the view shown in FIG. 3, but showing the damper system repositioned when the air conditioner is operating in an economizer cooling mode and with portions broken away for purposes of illustration.
Figure 6:
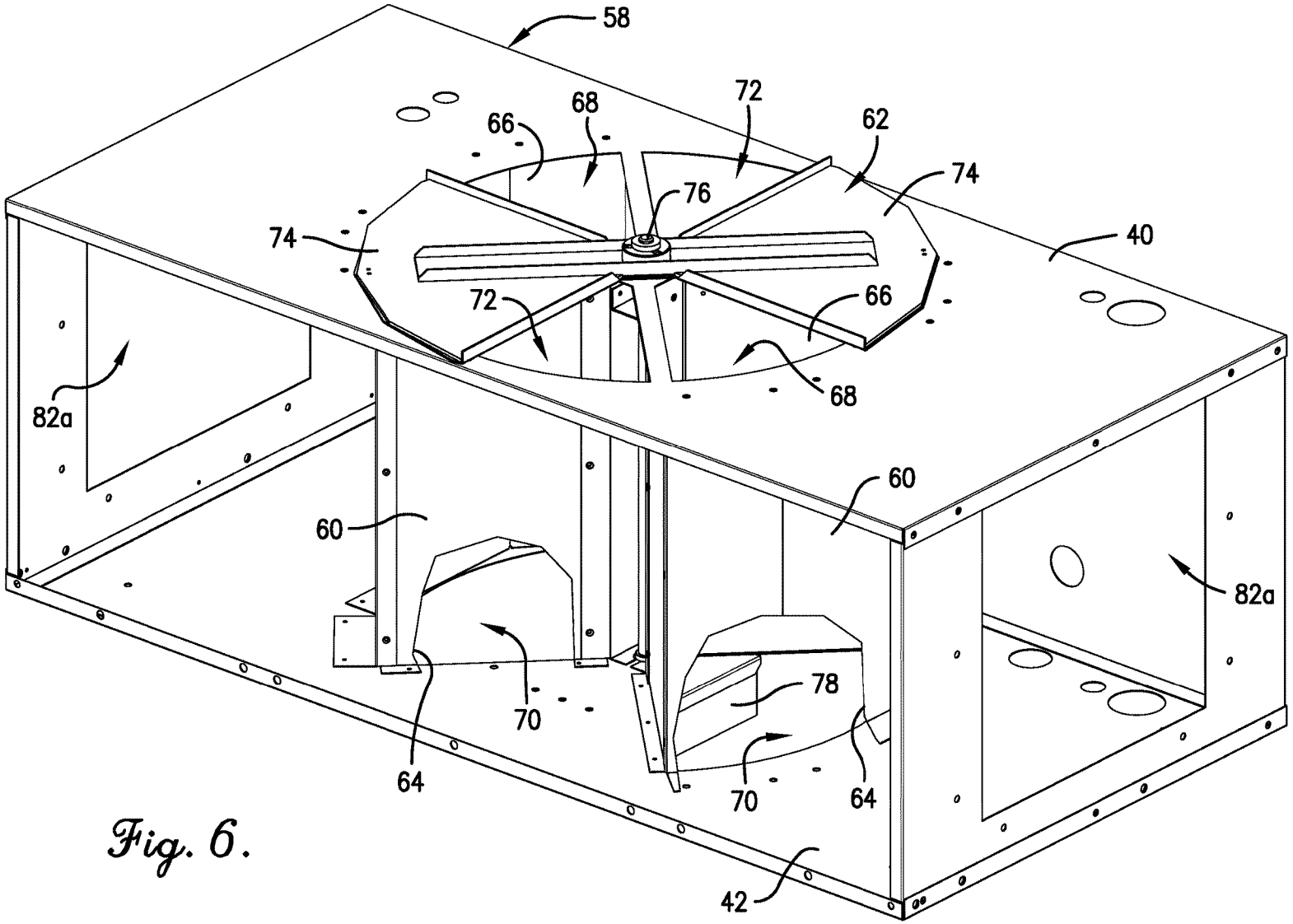
FIG. 6 is a rear perspective view of the economizer unit similar to the view shown in FIGS. 3 and 5, but showing the damper system in another position when the air conditioner is operating in the economizer cooling mode and with portions broken away for purposes of illustration.

In the exemplification described above, the plates 74 of the damper system 62 may be formed as opposing sectors of a common circle with each sector having a sufficient angular dimension so that each one of the plates 74 is able to fully close one of the conduits 60 and is rotatable about a vertical axis to fully close one of the return air recirculation openings 72. The plates 74 have a radial extent that allows them to overlay and be supported by a perimeter margin of the divider wall 40 surrounding the sectors of the upper discharge ends 66 of the conduits 60 and the return air recirculation openings 72. The plates 74 may be connected to an upper end of a vertically-extending center rod 76 that is connected at its lower end to an actuator 78 mounted to an underside of the divider wall 42 (FIG. 4). The actuator 78 is controllable to cause rotation of the center rod 76 and the plates 74 to thereby regulate the positioning of the plates 74 in relation to the upper discharge ends 66 of the conduits 60 and the return air recirculation openings 72. It will be appreciated that the plates 74 may be rotated to a position fully blocking the upper discharge ends 66 of the conduits 60 when the air conditioner 10 is operating in the mechanical cooling mode. The plates 74 may be rotated to another position fully blocking the return air recirculation openings 72 when the air conditioner is operating in the economizer cooling mode. The plates 74 may also be rotated to other positions blocking only selected portions of the upper discharge ends 66 of the conduits 60 and the return air recirculation openings 72 to allow passage of selected quantities of both the fresh outside air and the recirculating return air into the blower compartment 50. Mixing of the fresh outside air and the recirculating return air may be desired when the temperature of the fresh outside air is below a preselected set point temperature, such as 50 degrees Fahrenheit, and mixing with recirculating return air is necessary to raise the temperature of the supply air being delivered to the enclosed structure.

The economizer unit 58 is open to the return air opening 36 in the rear panel 22 and is also open to return air discharge ducts 80 positioned on opposite sides of the cabinet 14. Each of the return air discharge ducts 80 includes a return air discharge opening 82 in the respective side panel 16 or 18 and an aligned return air discharge opening 82*a* in any separate side wall that may form part of the economizer unit 58. The return air discharge ducts 80 each include a hinged damper plate 84 that operates as a one-way valve that, when open, allows the return air to be discharged from within the economizer compartment 56 to the outside of the cabinet 14 and, when closed, prevents fresh outside air from flowing through the duct 80 and the return air discharge opening 82 into the economizer compartment 56. A biasing force, such as the force of gravity, urges the damper plate 84 towards a closed position to prevent entry of fresh outside air or debris into the return air opening 82. Sufficient pressure within the economizer compartment 56 is able to overcome the biasing force to allow the return air to be exhausted through the return air discharge ducts 80. This pressure results from operation of the blowers 52 and positioning of the damper system 62 to fully or partially close the return air recirculation openings 72 in the divider wall 40 during operation of the air conditioner 10 in the economizer cooling mode.

In one exemplification, the damper plate 84 is spaced outwardly at its hinged lower end from the side panel 16 or 18. When in the closed position, the damper plate 84 is angled toward the side panel 16 or 18 and rests on a pair of inclined side supports 86 with a top end of the damper plate 84 positioned against the side panel 16 or 18. When in the open position, the top end of the damper plate 84 is moved away from the side panel 16 or 18 and off of the side supports 86 so that the duct 80 is open to allow the discharge of the return air from within the cabinet 14. A stop 88 may be provided to prevent the damper plate 84 from fully opening so that it maintains an inclined orientation that facilitates the return of the damper plate 84 to the closed position under the force of gravity.

Each of the return air discharge ducts 80 comprises a box-like structure have an imperforate lower portion 90, a perforated upper portion 92, and a closed top 94 that shields against entry of debris into the duct 80. The lower imperforate portion 90 is in horizontal alignment with the return air discharge opening 82 in the side panel 16 or 18 so that return air that exits in a horizontal direction from the economizer compartment 56 through the return air discharge opening 82 is turned upwardly by the imperforate lower portion 90 and exits with an upward momentum through the perforated upper portion 92.

Returning to FIGS. 7-10, a condenser compartment 96 is positioned immediately below the economizer compartment 56 and is bounded at the top by the divider wall 42 and at the bottom by the bottom panel 26. The condenser compartment 96 houses a pair of condenser coil assemblies 98 that are shown somewhat schematically and are positioned at opposite sides of the condenser compartments 96 adjacent the side panels 16 and 18 of the cabinet 14, a compressor 100, and an exhaust fan unit 102. The condenser coil assemblies 98, compressor 100, and exhaust fan unit 102 form part of the compression refrigeration system, further details of which will be readily known to those of ordinary skill in the field of refrigeration systems.

The front panel 20 of the cabinet 14 includes a circular fan opening 104 that is aligned with the exhaust fan unit 102 to allow operation of the exhaust fan unit 102 to expel air outwardly through the front panel 20 during operation of the air conditioner 10 in the mechanical cooling mode. The side panels 16 and 18 of the cabinet 14 include inlet openings 106 aligned with the condenser coil assemblies 98 to allow fresh outside air to be drawn into the condenser compartment 96 and through the condenser coil assemblies 98 for heat transfer during operation of the exhaust fan unit 102. During operation of the air conditioner 10 in the economizer cooling mode, fresh outside air is drawn through the circular fan opening 104 and/or the side panel inlet openings 106 by operation of the blowers 52 and opening of the conduits 60. Protective grills 108 and 110 are positioned over the side panel inlet openings 106 and the circular fan opening 104, respectively.

Figure 7:
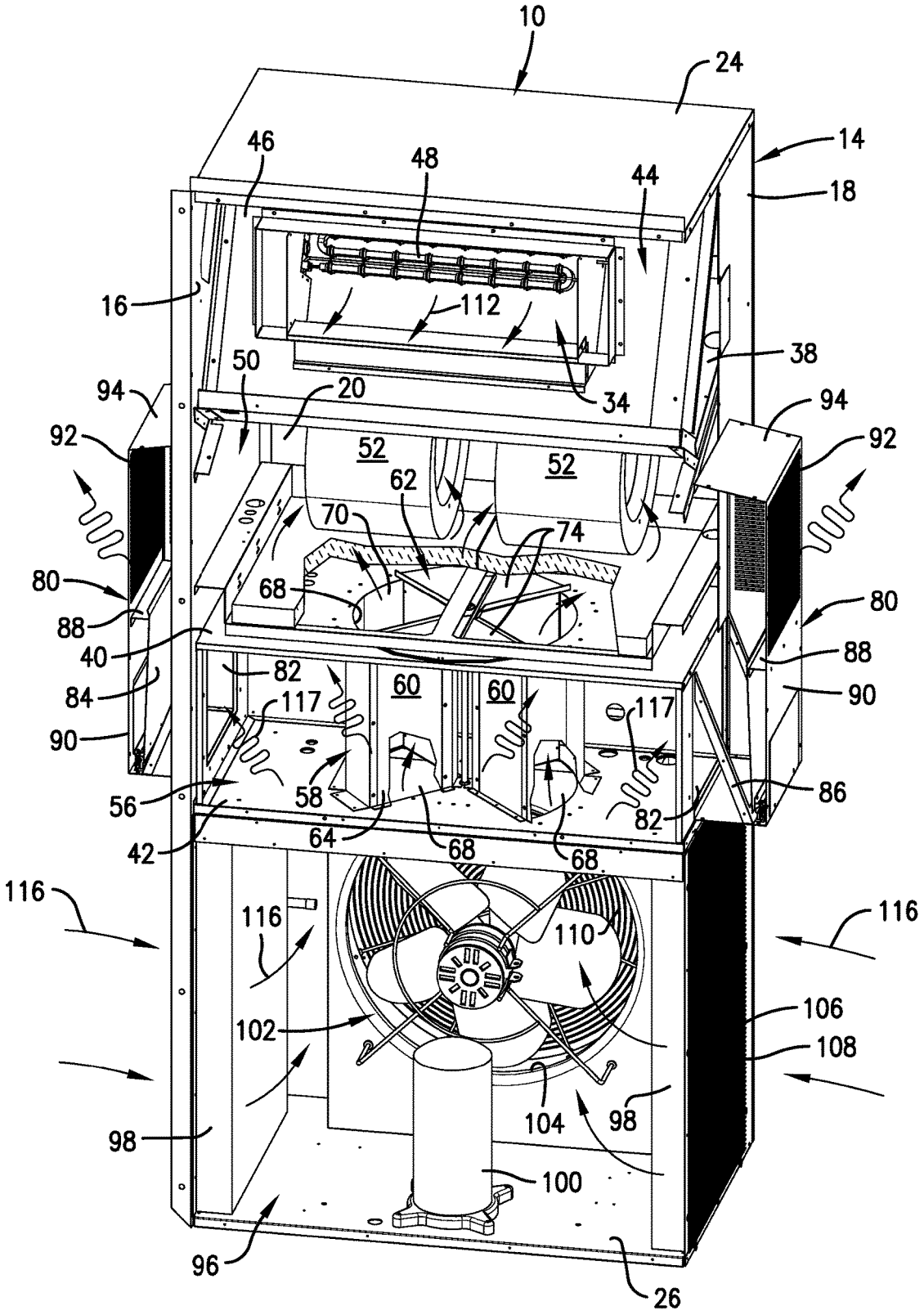
FIG. 7 is a rear perspective view of the air conditioner similar to the view shown in FIG. 2, with portions of a cabinet of the air conditioner removed to show the damper system of the economizer unit as positioned when the air conditioner is operating in an economizer cooling mode and with arrows used to illustrate the supply air and return air flows.
Figure 8:
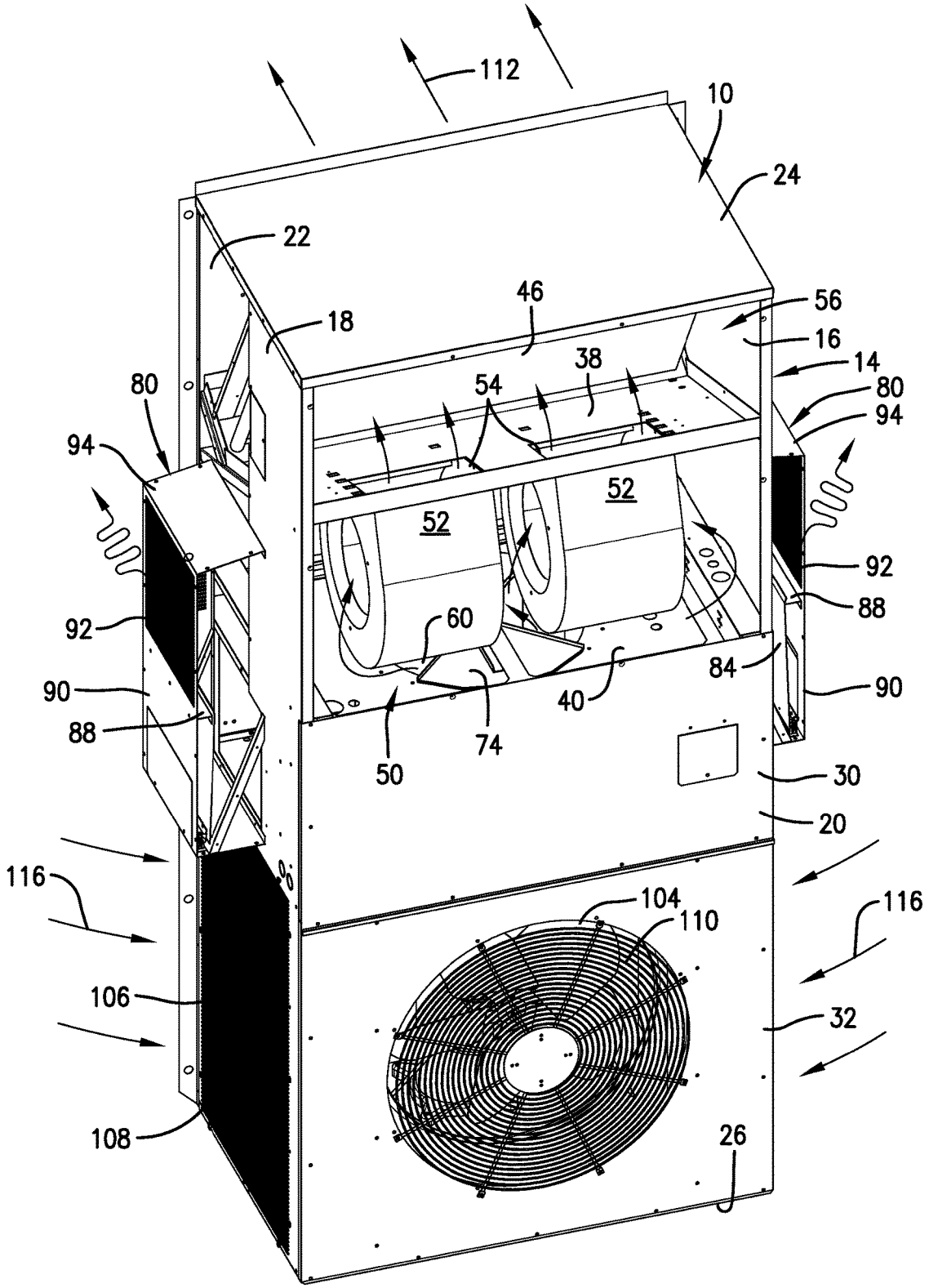
FIG. 8 is a rear perspective view of the air conditioner with portions of the cabinet removed to show the damper system of the economizer unit as positioned when the air conditioner is operating in the economizer cooling mode.
Figure 9:
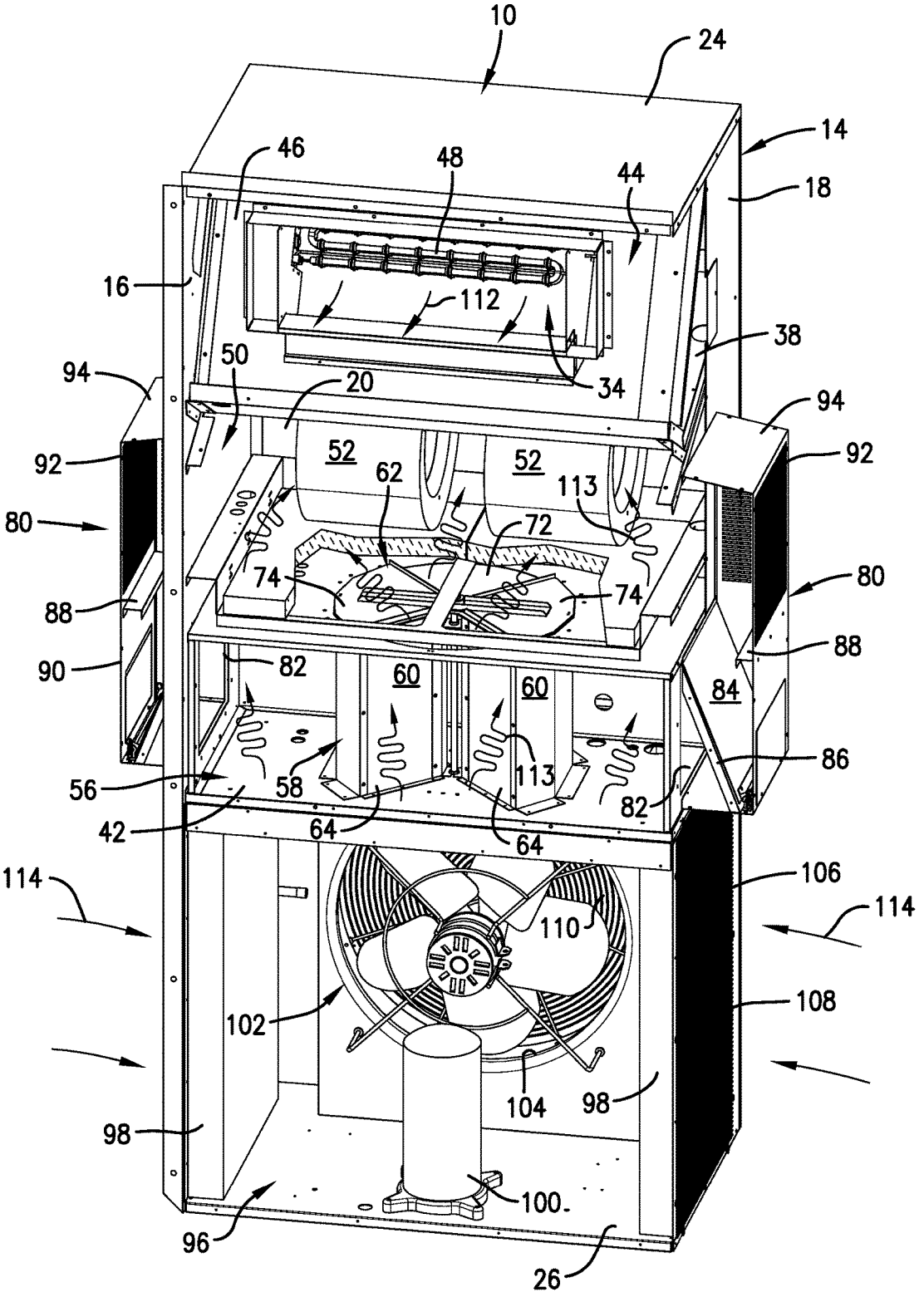
FIG. 9 is a rear perspective view of the air conditioner similar to the view shown in FIG. 7, but with the damper system of the economizer unit as positioned when the air conditioner is operating in a mechanical cooling mode.

Operation of the air conditioner 10 in the mechanical cooling mode and in the economizer cooling mode will now be described with reference to FIGS. 7-10. Turning first to FIG. 9, the air conditioner 10 is shown in the mechanical refrigeration mode with the compression refrigeration system operating to cause cooling of the recirculating return air as it is delivered across the chilled evaporator coil unit. This cooled recirculating return air is delivered as cooled supply air indicated by the directional arrows 112 into the enclosed structure through the supply air opening 34 in the rear panel 22 of the cabinet 14 and the aligned opening (not shown) in the exterior wall 12 (FIG. 1). Return air from the enclosed structure enters the economizer compartment 56 through the return air opening 36 in the rear panel 22 and the aligned opening (not shown) in the exterior wall 12 (FIG. 1). The return air is designated by the serpentine lines 113 as it is drawn through the return air recirculation openings 72 in the divider wall 40 and enters the blowers 52 for delivery across the chilled evaporator coil assembly 46 as described above. Concurrently, fresh outside air is drawn by operation of the exhaust fan unit 102 through the side panel inlet openings 106 as designated by the directional arrows 114 and across the condenser coil assemblies 98 for cooling thereof before being expelled in a horizontal direction through the circular fan opening 104 in the front panel 20.

The air conditioner 10 may be switched by a suitable controller to the economizer cooling mode when the fresh outside air is below a set temperature and dew point. As shown in FIGS. 7 and 8, the damper system 62 is activated to move the plates 74 from the position blocking the conduits 60 to the position blocking the return air recirculation openings 72. Fresh outside air is then drawn into the compressor compartment 96 through the side panel inlet openings 106 and/or the circular fan opening 104 as designated by the directional arrows 116, travel upwardly through the return air discharge ducts 80 in the economizer unit 58, and then enter the blower compartment 50. The blowers 52 deliver the fresh outside air to the evaporator compartment 44 and across the unchilled evaporator coil assembly 46 for delivery as supply air to the enclosure structure. Meanwhile, the return air from the enclosed structure is blocked by the plates 74 from entering the blower compartment 50 and is instead directed through the openings 81 in the side panels 16 of the cabinet 14 and into the return air discharge ducts 80 as indicated by the serpentine arrows 117. The return air is discharged in an outward and upward direction from the perforated upper portion 92 of the return air discharge ducts 80 at an elevation that is spaced sufficiently above the underlying side panel inlet openings 106 to prevent or minimize the re-ingestion or entrainment of the discharged return air into the fresh outside air that is drawn through the side panel openings 106 for ultimate delivery as supply air to the enclosed structure. As a result of this segregation of the discharged return air from the entering fresh outside air, the discharged return air does not cause appreciable warming of the entering fresh outside air, thereby allowing the air conditioner 10 to remain operating in the economizer cooling mode when mixing of the discharged return air with the entering fresh outside air might otherwise cause the air conditioner to be switched by the controller to the mechanical refrigeration mode because of the elevated air temperature.

Figure 10:
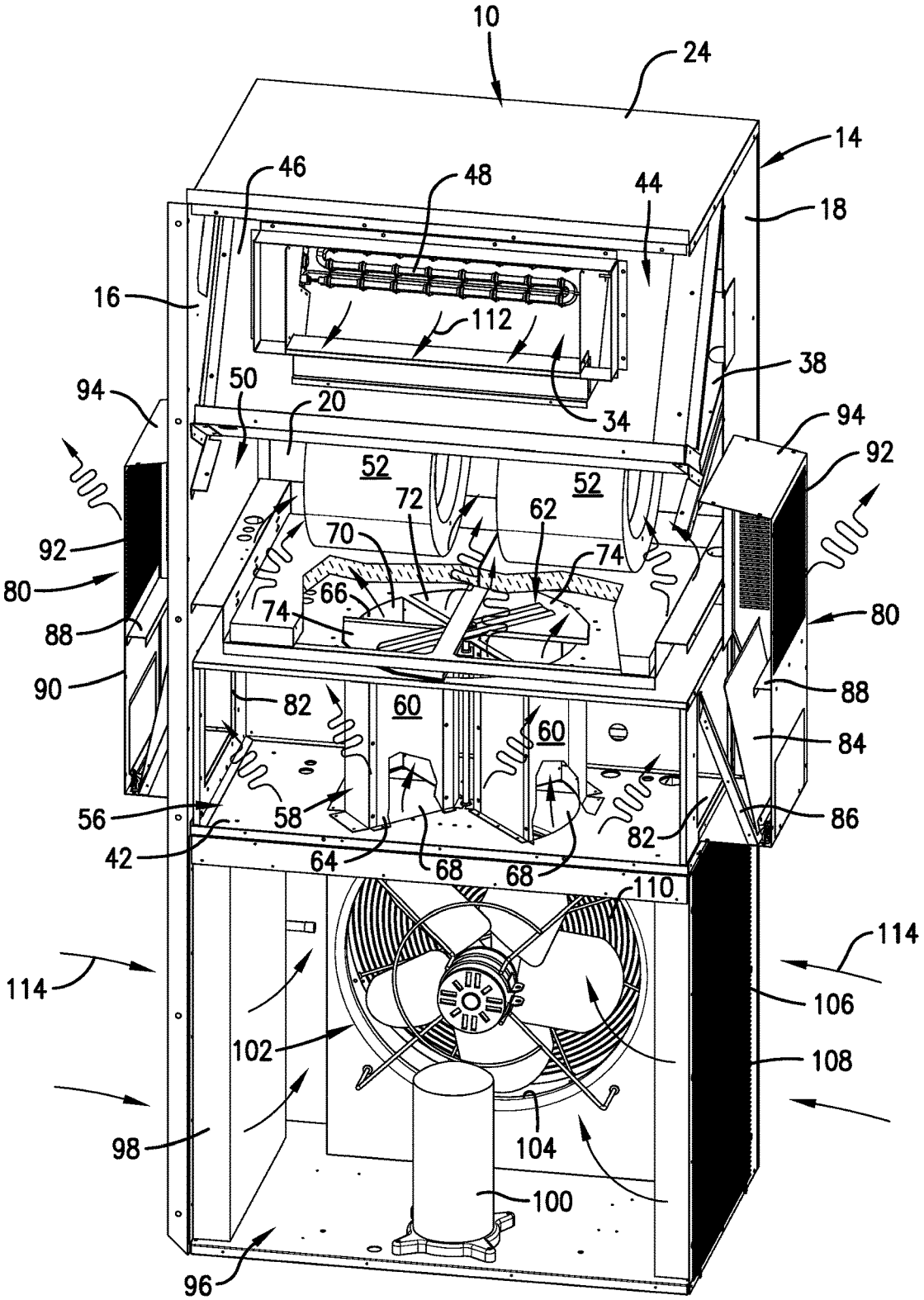
FIG. 10 is a rear perspective view of the air conditioner similar to the view shown in FIGS. 7 and 9, but with the damper system of the economizer unit shown in a different position when the air conditioner is operating in the economizer cooling mode.

In situations where mixing of some amount of return air with the entering fresh outside air, the damper system 62 can be activated to move the plates 74 so that they only partially block the upper discharge ends 66 of the conduits 60 and the return air recirculation openings 72, as shown in FIG. 10.

The relative volumetric quantities of fresh outside air and return air entering the blower compartment 50 for subsequent delivery to the enclosed structure as supply air is regulated by the controller's positioning of the plates 74 of the damper system 62. For example, if greater quantities of return air are desired, the plates 74 are moved to block less of the return air recirculation openings 72 and more of the upper discharge ends 66 of the conduits 60. Conversely, when more fresh outside air is desired, the plates are moved to block less of the upper discharge ends 66 of the conduits 60 and more of the return air recirculation openings 72.

From the foregoing, it will be seen that this invention is one well adapted to attain all the ends and objectives hereinabove set forth together with other advantages that are inherent to the structure.

It will be understood that certain features and sub combinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A single-package, wall-mount air conditioner operable in a mechanical cooling mode and an economizer cooling mode, said single-package, wall-mount air conditioner comprising:

a cabinet comprising a pair of side panels, a front panel, a rear panel, a top panel, a bottom panel, that are interconnected together, said cabinet including divider walls that extend between the side, front and rear panels to separate an evaporator compartment from a blower compartment, the blower compartment from an economizer compartment, and the economizer compartment from a condenser compartment within the cabinet;

a supply air opening in the rear panel through which cooling supply air may be discharged from the evaporator compartment;

a return air opening in the rear panel through which the cooling supply air after discharge from the cabinet may be recirculated to the economizer compartment as return air;

a compression refrigeration system positioned within the cabinet and operable to cause cooling of the supply air within the cabinet when the air conditioner is operating in the mechanical cooling mode, said compression refrigeration system comprising an evaporator coil assembly positioned in the evaporator compartment and a condenser coil assembly and an exhaust fan unit positioned in the condenser compartment;

an opening in the cabinet through which fresh outside air may enter the condenser compartment;

a return air discharge opening in the cabinet through which the return air in the economizer compartment may be outwardly discharged from the cabinet;

a return air recirculation opening in the divider wall separating the blower compartment from the economizer compartment through which the return air in the economizer compartment may be routed to the blower compartment;

a duct extending from the return air discharge opening and having an imperforate portion positioned to upwardly turn the outwardly discharged return air;

a blower positioned in the blower compartment for effecting movement of the supply air, the return air, and the fresh outside air within the cabinet; and an economizer unit positioned within the economizer compartment and comprising a conduit through which the fresh outside air may flow from the condenser compartment to the blower compartment and a damper system that is selectively operable to open and close said conduit to said flow of the fresh outside air through the conduit and to open and close said return air recirculation opening to said routing of the return air from the economizer compartment to the supply air opening.

2. The single-package, wall-mount air conditioner of claim 1, wherein said conduit includes a damper plate that is moveable between an open position allowing said return air to flow through the conduit and a closed position impeding or preventing said flow.

3. The single-package, wall-mount air conditioner of claim 1, wherein said damper system comprises a plate that is movable between a position blocking a discharge end of the conduit and another position blocking said return air recirculation opening.

4. The single-package, wall-mount air conditioner of claim 3, including a second one of said conduits and a second one of said return air recirculation openings and wherein said damper system comprises a second one of said plates that is movable between a position blocking a discharge end of the second one of the conduits and another position blocking said second one of the return air recirculation openings.

5. The single-package, wall-mount air conditioner of claim 4, wherein said conduits extend upwardly.

6. The single-package, wall-mount air conditioner of claim 5, wherein said conduits have upper discharge ends that are coplanar with the return air recirculation openings and are shaped and arranged so that they form opposing sectors of a common circle.

7. The single-package, wall-mount air conditioner of claim 6, wherein said return air recirculation openings are shaped and arranged so that they form opposing sectors of the common circle with the upper discharge ends of the conduits.

8. The single-package, wall-mount air conditioner of claim 7, wherein said plates of the damper system are formed as sectors and are mounted for rotation between the position blocking the discharge ends of the conduits and said another position blocking said return air recirculation openings.

9. A single-package, wall-mount air conditioner operable in a mechanical cooling mode and an economizer cooling mode, said single-package, wall-mount air conditioner comprising:

a cabinet comprising a pair of side panels, a front panel, a rear panel, a top panel, a bottom panel, that are interconnected together, said cabinet including divider walls that extend between the side, front and rear panels to separate an evaporator compartment from a blower compartment, the blower compartment from an economizer compartment, and the economizer compartment from a condenser compartment within the cabinet;

a supply air opening in the rear panel through which cooling supply air may be discharged from the evaporator compartment;

a return air opening in the rear panel through which the cooling supply air after discharge from the cabinet may be recirculated to the economizer compartment as return air;

a compression refrigeration system positioned within the cabinet and operable to cause cooling of the supply air within the cabinet when the air conditioner is operating in the mechanical cooling mode, said compression refrigeration system comprising an evaporator coil assembly positioned in the evaporator compartment and a condenser coil assembly and an exhaust fan unit positioned in the condenser compartment;

an opening in the cabinet through which fresh outside air may enter the condenser compartment;

a return air discharge opening in the cabinet through which the return air in the economizer compartment may be outwardly discharged from the cabinet;

a return air recirculation opening in the divider wall separating the blower compartment from the economizer compartment through which the return air in the economizer compartment may be routed to the blower compartment;

a duct extending from the return air discharge opening and having an imperforate portion positioned to upwardly turn the outwardly discharged return air;

a blower positioned in the blower compartment for effecting movement of the supply air, the return air, and the fresh outside air within the cabinet; and an economizer unit positioned within the economizer compartment and comprising a conduit through which the fresh outside air may flow from the condenser compartment to the blower compartment and a damper system that is selectively operable to open and close said conduit to said flow of the fresh outside air through the conduit and to open and close said return air recirculation opening to said routing of the return air from the economizer compartment to the supply air opening, wherein said conduit includes a damper plate that is moveable between an open position allowing said return air to flow through the conduit and a closed position impeding or preventing said flow, wherein said damper system comprises a plate that is movable between a position blocking a discharge end of the conduit and another position blocking said return air recirculation opening.

10. The single-package, wall-mount air conditioner of claim 9, including a second one of said conduits and a second one of said return air recirculation openings and wherein said damper system comprises a second one of said plates that is movable between a position blocking a discharge end of the second one of the conduits and another position blocking said second one of the return air recirculation openings.

11. The single-package, wall-mount air conditioner of claim 10, wherein said conduits extend upwardly.

12. The single-package, wall-mount air conditioner of claim 11, wherein said conduits have upper discharge ends that are coplanar with the return air recirculation openings and are shaped and arranged so that they form opposing sectors of a common circle.

13. The single-package, wall-mount air conditioner of claim 12, wherein said return air recirculation openings are shaped and arranged so that they form opposing sectors of the common circle with the upper discharge ends of the conduits.

14. A single-package, wall-mount air conditioner operable in a mechanical cooling mode and an economizer cooling mode, said single-package, wall-mount air conditioner comprising:

a cabinet comprising a pair of side panels, a front panel, a rear panel, a top panel, a bottom panel, that are interconnected together, said cabinet including divider walls that extend between the side, front and rear panels to separate an evaporator compartment from a blower compartment, the blower compartment from an economizer compartment, and the economizer compartment from a condenser compartment within the cabinet;

a supply air opening in the rear panel through which cooling supply air may be discharged from the evaporator compartment;

a return air opening in the rear panel through which the cooling supply air after discharge from the cabinet may be recirculated to the economizer compartment as return air;

a compression refrigeration system positioned within the cabinet and operable to cause cooling of the supply air within the cabinet when the air conditioner is operating in the mechanical cooling mode, said compression refrigeration system comprising an evaporator coil assembly positioned in the evaporator compartment and a condenser coil assembly and an exhaust fan unit positioned in the condenser compartment;

an opening in the cabinet through which fresh outside air may enter the condenser compartment;

a return air discharge opening in the cabinet through which the return air in the economizer compartment may be outwardly discharged from the cabinet;

a return air recirculation opening in the divider wall separating the blower compartment from the economizer compartment through which the return air in the economizer compartment may be routed to the blower compartment;

a duct extending from the return air discharge opening and having an imperforate portion positioned to upwardly turn the outwardly discharged return air;

a blower positioned in the blower compartment for effecting movement of the supply air, the return air, and the fresh outside air within the cabinet;

an economizer unit positioned within the economizer compartment and comprising a conduit that extends upwardly and through which the fresh outside air may flow from the condenser compartment to the blower compartment and a damper system that is selectively operable to open and close said conduit to said flow of the fresh outside air through the conduit and to open and close said return air recirculation opening to said routing of the return air from the economizer compartment to the supply air opening, wherein said conduit includes a damper plate that is moveable between an open position allowing said return air to flow through the conduit and a closed position impeding or preventing said flow, wherein said damper system comprises a plate that is movable between a position blocking a discharge end of the conduit and another position blocking said return air recirculation opening; and a second one of said conduits and a second one of said return air recirculation openings and wherein said damper system comprises a second one of said plates that is movable between a position blocking a discharge end of the second one of the conduits and another position blocking said second one of the return air recirculation openings, wherein said conduits have upper discharge ends that are coplanar with the return air recirculation openings and are shaped and arranged so that they form opposing sectors of a common circle, wherein said return air recirculation openings are shaped and arranged so that they form opposing sectors of the common circle with the upper discharge ends of the conduits, wherein said plates of the damper system are formed as sectors and are mounted for rotation between the position blocking the discharge ends of the conduits and said another position blocking said return air recirculation openings.

* * * * *